United States Patent [19]

Markiw

[11] 4,125,959

[45] Nov. 21, 1978

[54] SOAP BUBBLE BLOWERS

[76] Inventor: Yarik Markiw, 415 W. Burnside, Portland, Oreg. 97209

[21] Appl. No.: 800,938

[22] Filed: May 26, 1977

[51] Int. Cl.[2] ..... A63H 33/28

[52] U.S. Cl. ..... 46/6; 46/44

[58] Field of Search ..... 46/6–8, 46/44

[56] References Cited

U.S. PATENT DOCUMENTS

| | | | |
|---|---|---|---|
| 2,587,535 | 2/1952 | Scott | 46/8 |
| 2,587,895 | 3/1952 | Quinn, Jr. et al. | 46/7 |
| 2,853,829 | 9/1958 | Greene | 46/8 |
| 3,695,148 | 10/1972 | Baginski et al. | 46/44 |

*Primary Examiner*—Louis G. Mancene
*Assistant Examiner*—Robert F. Cutting

[57] ABSTRACT

This invention relates to a device for blowing soap bubbles. The invention provides a tube for blowing air pressure through an oriface to a wand including a ring which contains a bubble forming surface. The wand and ring are actuated from a bubble solution reservoir which is erected to the path of air through the orfice by said air pressure.

1 Claim, 4 Drawing Figures

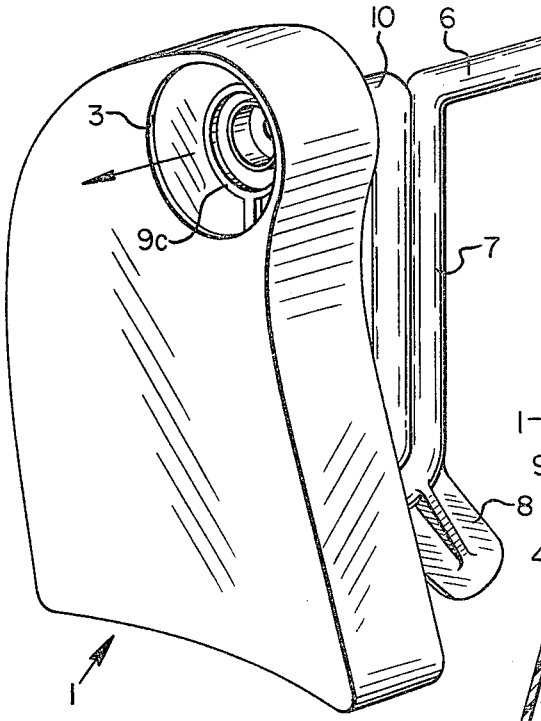
FIG. 1
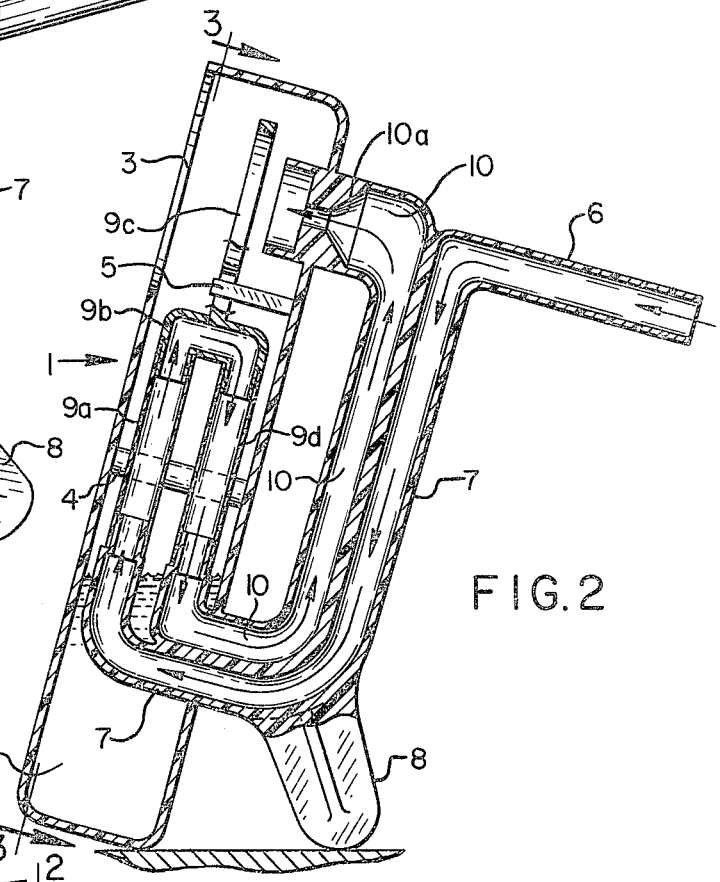
FIG. 2
FIG. 3
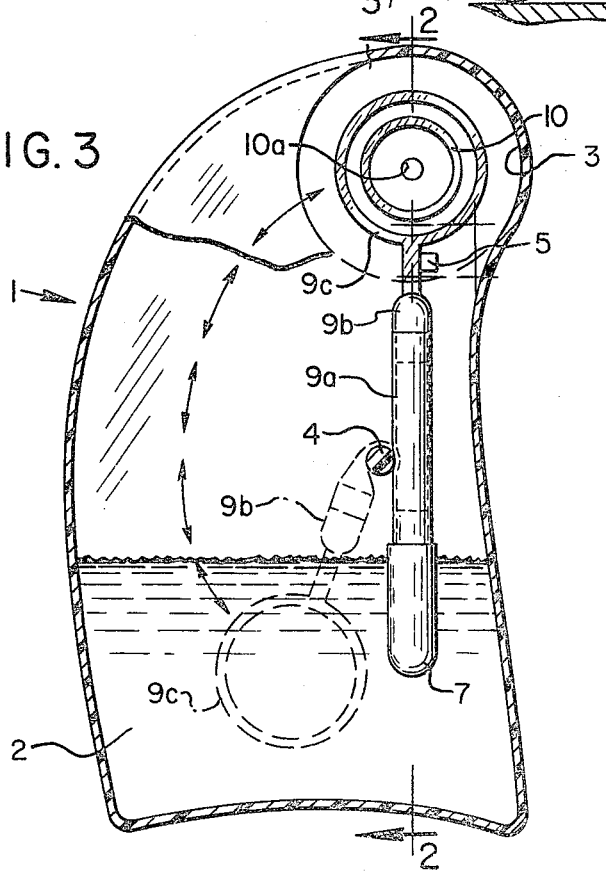
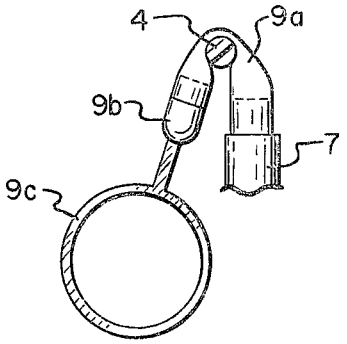
FIG. 4

SOAP BUBBLE BLOWERS

This invention relates to a device for blowing soap bubbles. It is an object of the invention to provide a soap bubble blower containing a soap solution reservoir, obviating the necessity of dipping the device in a separate container.

Another object is to provide a reciprocating bubble wand or the like contained within said soap solution reservoir, said bubble wand being raised and lower on a pivot within said reservoir.

Another object of the invention is to provide a bubble blower in which said bubble wand is mounted on the pneumatic tubulation of the device, and to be activated by said tubulation, in such manner as to be raised out of the soap solution when the tubulation is pressurized, and fall into the soap solution when unpressurized.

A further object of the invention is to provide that part of the tubulation hang on said pivot, thus forming a valve, with the effect that air may not be released from the device to form soap bubbles until the bubble wand is in position opposite the orifice.

Other objects of the invention are to provide a soap bubble blower which forms a stream of bubbles in response to every breath of air blown into the mouthpiece; to be constructed of transparent thermoplastic so that the visible action of the bubble wand may itself be a source of amusement; to be sturdy and simple of construction, so that a toy of long life and low cost may be realized.

Having described the general features of my invention, I shall now describe the several parts in detail, illustrated in four figures, in which:

FIG. 1 is an oblique perspective view

FIG. 2 is a side sectional view

FIG. 3 is a front view partly in section

FIG. 4 is an isolated view of the valve assembly.

Referring now to these drawings, my soap bubble blower comprises a reservoir compartment 1, and a tubulation system consisting of parts 6 through 10. I shall first describe the reservoir compartment 1 and then the tubulation system. The lower portion of compartment 1 contains the soap solution 2. It is poured into the compartment through an opening near the top of the compartment, the bubble outlet 3. The pivot 4 is a plastic rod that contacts the front and back walls of compartment 1, and is set perpendicular to the same. Stop 5 is a square rod of plastic that mounts on the back wall of compartment 1 and extends about halfway into the interior.

Having described the compartment, I shall now procedd with the tubulation. The tubulation begins with the mouthpiece 6 constructed of rigid plastic set behind compartment 1 and perpendicular to the same. Mouthpiece 6 communicates with the prevalve tubulation 7, which is set first parallel to compartment 1, descending downward to strut 8. Strut 8 supports the bubble blower when it is set on a flat surface. After struct 8 the prevalve tubulation 7 bends 90° and enters compartment 1, after which it again bends 90° and terminates parallel with compartment 1. The prevalve tubulation 7 communicates with the valve assembly 9, which has four parts, the pressurized rubber tubing **9*a*, the yoke 9*b*, the wand 9*c*, and the unpressurized rubber tubing 9*d*. The rubber tubing 9*a* and 9*d* are made of thin-walled latex and are connected together by yoke 9*b*, upon which is mounted the wand 9*c*. Unpressurized rubber tubing 9*d* communicates with the postvalve tubulation 10. Postvalve tubulation 10 descends a short distance downward, then bends 90° and exits compartment 1 parallel to prevalve tubulation 7. It again bends 90° and continues parallel to part 7 until it reaches the area of the mouthpiece 6. From that point part 10 bends 90° and enters compartment 1 near the top and terminates with a venturi 10*a* which is concentric with bubble outlet 3**.

The normal position of valve assembly 9 is shown in FIG. 4, where the assembly hangs over pivot 4. The level of soap solution 2 must not submerge yoke **9*b*, lest the assembly float and not seat properly on pivot 4. In operation, the user applies air pressure through the mouthpiece 6. Since the valve assembly is in the position shown in FIG. 4, pressurized rubber tubing 9*a* is pinched closed, which prohibits the flow of air. However, when sufficient pressure is applied, valve assembly 9 springs up and assumes the position shown in FIG. 3. Stop 5 serves to prevent oscillation of the bubble wand at this point. The bubble wand 9*c* having been submerged in the soap solution, acquires a soap film across its inner diameter. The erection of the valve assembly opens tubings 9*a* and 9*d* and permits the pressurized air to exit venturi 10*a*, thus forming soap bubbles exiting bubble outlet 3. Venturi 10*a* serves two functions. First, it increases the air velocity to easily produce soap bubbles across the soap film in wand 9*c*; second, as it is the smallest air passageway in the entire tubulation, it acts to pressurize tubings 9*a* and 9*d* to keep valve assembly 9 erect, even while a relatively small volume of air is blown into the mouthpiece. The advantage of this latter mentioned function will be obvious, since it is a characteristic of all soap bubble blowers that high air pressure produces a multiplicity of small bubbles, while low air pressure produces large bubbles, all other factors being equal. When the flow of air through the tubulation ceases, rubber tubings 9*a* and 9*d* immediately collapse, assuming once again the position shown in FIG. 4, and the cycle may be repeated. It is of advantage that yoke 9*b* and wand 9*c* be constructed as lightweight as possible, since the lighter these components, the less air pressure is required to cause erection of valve assembly 9**.

While the embodiment of the invention herein described is believed to be the simplest and most economical of application, it is to be understood that such is not to be constructed as imparting limitations upon the invention, which is best defined by the claim appended hereto.

Having thus described my invention, I claim as new and desire to secure by Letters Patent:

1. A soap bubble blower comprising a soap solution reservoir, a reciprocating bubble wand or the like mounted on a yoke communicating with flexible tubing which hangs on a pivot carried in said reservoir, said flexible tubing communicating with rigid tubing forming inlet and outlet parts, a valve consisting of said flexible tubing, yoke, and bubble wand such that said valve is closed when said flexible tubing rests on said pivot, but open when subject to air pressure, so that said bubble wand is drawn out of the soap solution and stop opposite said outlet, at the same time forming soap bubbles, said flexible tubing being distended by a venturi in said outlet, said valve closing and coming to rest upon said pivot when no longer subject to air pressure, said bubble wand at the same time drawn into said soap solution.

* * * * *